US009472041B2

(12) United States Patent
Roxas et al.

(10) Patent No.: US 9,472,041 B2
(45) Date of Patent: Oct. 18, 2016

(54) CLAMPING OF MEDIA ITEMS

(71) Applicant: NCR CORPORATION, Duluth, GA (US)

(72) Inventors: Joseph Roxas, Cebu (PH); Carlo Granaderos, Talisay (PH)

(73) Assignee: NCR CORPORATION, Duluth, GA (US)

( * ) Notice: Subject to any disclaimer, the term of this patent is extended or adjusted under 35 U.S.C. 154(b) by 54 days.

(21) Appl. No.: 14/068,629

(22) Filed: Oct. 31, 2013

(65) Prior Publication Data

US 2015/0114795 A1 Apr. 30, 2015

(51) Int. Cl.

| | |
|---|---|
| ***G07F 1/04*** | (2006.01) |
| ***G07D 13/00*** | (2006.01) |
| ***G07D 11/00*** | (2006.01) |
| ***G07F 19/00*** | (2006.01) |
| ***G07F 7/04*** | (2006.01) |
| ***G07F 11/04*** | (2006.01) |

(52) U.S. Cl.

CPC ..... *G07D 13/00* (2013.01); *G07D 11/0003* (2013.01); *G07D 11/0018* (2013.01); *G07D 11/0021* (2013.01); *G07D 11/0024* (2013.01); *G07D 11/0027* (2013.01); *G07D 11/0033* (2013.01); *G07F 7/04* (2013.01); *G07F 11/045* (2013.01); *G07F 19/00* (2013.01); *G07F 19/202* (2013.01); *G07F 19/205* (2013.01); *B65H 2301/4314* (2013.01); *B65H 2403/942* (2013.01); *B65H 2404/63* (2013.01); *B65H 2701/182* (2013.01); *B65H 2701/1912* (2013.01)

(58) Field of Classification Search

CPC ..... G07D 11/0003; G07D 11/0006; G07D 11/0009; G07D 11/0012; G07D 11/0015; G07D 11/0018; G07D 11/0021; G07D 11/0024; G07D 11/0027; G07D 11/003; G07D 11/0033; G07D 2207/00; G07D 2211/00; G07D 7/00; G07D 7/06; G07D 7/12;G07D 11/10; G07D 11/00; G07F 19/205; G07F 11/16; G07F 19/00; G07F 7/04; G07F 19/202; B65H 5/12; B65H 31/00; B65H 29/14; B65H 29/58; B65H 2701/1912; B65H 2301/332; B65H 2404/63; B65H 2301/4455; B65H 2408/112; B65H 29/60; B65H 2408/111; B65H 29/12; B65H 31/3027; B65H 2403/942; B65H 2404/254; B65H 2404/691; B65H 2701/182; B65H 2301/4314; B65G 47/248; B65G 47/252; B65G 47/256; B65G 57/081

USPC ..... 194/206, 207, 344, 346; 209/534; 235/379; 414/788.5, 788.6; 271/301–303, 902, 10.01, 10.06, 306, 271/3.01, 3.08, 34, 121, 126, 147, 279, 271/225; 902/15, 16

See application file for complete search history.

(56) References Cited

U.S. PATENT DOCUMENTS 5,927,936 A * 7/1999 Arikawa et al. ..... 414/788
6,318,714 B1 * 11/2001 Beskitt et al. ..... 271/10.01

(Continued)

*Primary Examiner* — Jeffrey Shapiro
(74) *Attorney, Agent, or Firm* — Schwegman, Lundberg & Woessner

(57) ABSTRACT

The present invention provides apparatus and a method for transporting at least one media item along a transport path, comprising locating a bunch of media items between at least one support surface and at least one clamp surface, and selectively moving said clamp surface towards or away from said support surface to apply a predetermined clamp force to the bunch of media items, wherein a predetermined angle of said clamp surface relative to said support surface is substantially constant when said clamp surface is moved towards or away from said support surface.

8 Claims, 11 Drawing Sheets

(56) References Cited

U.S. PATENT DOCUMENTS 7,422,118 B2 * 9/2008 Ugo et al. ..... 209/534
7,708,192 B2 * 5/2010 Yokoi et al. ..... 235/379
8,262,076 B2 * 9/2012 Wilson ..... B65H 1/14 271/10.01
8,757,348 B2 * 6/2014 Yoshikawa et al. ..... 194/206
9,022,383 B2 * 5/2015 Huang ..... G07D 11/0021 271/198
9,082,246 B2 * 7/2015 Boon ..... G07D 11/0033
2004/0251588 A1 * 12/2004 Panini et al. ..... 271/3.14
2005/0035531 A1 * 2/2005 Sasaki et al. ..... 271/126
2007/0023988 A1 * 2/2007 Abe et al. ..... 271/3.01
2009/0206541 A1 * 8/2009 Nutzel et al. ..... 271/10.01
2012/0007304 A1 * 1/2012 Wilson ..... B65H 1/14 271/10.01
2012/0161386 A1 * 6/2012 Deas et al. ..... 271/157
2014/0175733 A1 * 6/2014 Huang ..... G07D 11/0021 271/18
2015/0034452 A1 * 2/2015 Boon ..... G07D 11/0033 194/344

* cited by examiner

CLAMPING OF MEDIA ITEMS

FIELD OF THE INVENTION

The present invention relates to a method and apparatus for transporting media items along a transport path. In particular, but not exclusively, the present invention relates to transporting media items, such as currency notes, checks, or the like, along a transport path within a media item processing module and clamping the media items with a desired force at a predetermined location on the transport path while the media item processing module is in a predetermined mode of operation.

Various situations are known in which media items are transported along a transport pathway in a Self-Service Terminal (SST). For example, in a typical check depositing Automated Teller Machine (ATM), an ATM customer is allowed to deposit a check (without having to place a check in the deposit envelope) in a publically accessible, unattended environment. To deposit a check, the ATM customer inserts an identification card through a card slot of the ATM, enters the amount of the check being deposited and inserts check to be deposited through a check slot of a check acceptor. A check transport mechanism receives the inserted check and transports the check in a forward direction along an "infeed" check transport path to a number of locations within the ATM to process the check. Other forms of media item may include currency notes, coupons, vouchers, tokens, or the like, and the media item may include one media item or a number of media items in the form of a bunch of media items.

A conventional check transport mechanism includes a first transport member and an opposed second transport member facing the first transport member for transporting a bunch of media items located between the first and second transport members along a transport path. Each of the transport members include a transport belt to grip and move the bunch of media items along the transport path. A compression force is applied to the bunch of media items by one or both of the transport members such that the media items of the bunch are transported together.

However, in certain modes of operation of an SST, a compression force applied to a bunch of media items may not be suitable for all other modes of operation, such as when separating a media item from a bunch of media items. This can cause failure during certain operations at the SST.

SUMMARY OF THE INVENTION

It is an aim of the present invention to at least partly mitigate the above-mentioned problems.

It is an aim of certain embodiments of the present invention to provide a method and apparatus for effectively transporting a bunch of media items along at least one transport path within an SST.

It is an aim of certain embodiments of the present invention to provide a method and apparatus for effectively removing or adding a media item from/to a bunch of media items.

It is an aim of certain embodiments of the present invention to provide a method and apparatus for applying a predetermined clamp force to a bunch of media items located on a transport path of a media item processing module.

It is an aim of certain embodiments of the present invention to provide a self-adjusting clamping mechanism for applying a predetermined clamp force to a bunch of media items dependent upon a mode of operation of a media item processing module.

It is an aim of certain embodiments of the present invention to provide a method and apparatus for applying a predetermined clamp force to a bunch of media items in an accurate and repeatable manner without adversely affecting bunch feeding/picking/separation operations.

According to a first aspect of the present invention there is provided a method of transporting at least one media item along a transport path, comprising:

locating a bunch of media items between at least one support surface and at least one clamp surface; and selectively moving said clamp surface towards or away from said support surface to apply a predetermined clamp force to the bunch of media items; wherein a predetermined angle of said clamp surface relative to said support surface is substantially constant when said clamp surface is moved towards or away from said support surface.

Aptly, the method further comprises:

selectively rotating at least one elongate drive member coupled at a first end region of said drive member to a clamp member comprising said clamp surface; and automatically adjusting the angle of said clamp surface responsive to rotation of the at least one drive member such that the predetermined angle of said clamp surface relative to said support surface is substantially constant when said clamp surface is moved towards or away from said support surface.

Aptly, the method further comprises:

guiding at least one link member along a predetermined guide path during said rotation of the at least one drive member to automatically adjust an orientation of the clamp member, wherein a first end region of said link member is pivotally connected to said drive member and a further end region of said link member is pivotally connected to said clamp member.

Aptly, the predetermined angle is from around 0 degrees to around 10 degrees.

Aptly, the predetermined angle is around 3.5 degrees.

Aptly, the clamp surface remains in parallel with said support surface when said clamp surface is moved towards or away from said support surface such that the predetermined angle is 0 degrees.

Aptly, the method further comprises:

determining a thickness associated with the bunch of media items; and selectively moving said clamp surface towards or away from said support surface responsive to the thickness.

Aptly, the method further comprises:

removing or adding a media item from or to the bunch of media items to respectively decrease or increase said thickness of the bunch of media items and moving the clamp surface to maintain the predetermined clamp force as the thickness is decreased or increased.

Aptly, the method further comprises:

determining said thickness of the bunch of media items by sensing a displacement of a moveable element that is moveable towards or away from the clamp surface responsive to said thickness of the bunch of media items; and selectively moving the clamp surface towards or away from the support surface to apply the predetermined clamp force to the bunch of media items responsive to a displacement of the moveable element.

Aptly, the method further comprises biasing said moveable element towards said clamp surface.

According to a second aspect of the present invention there is provided apparatus for transporting at least one media item along a transport path, comprising:

at least one clamp surface to apply a clamp force to a bunch of media items located between a support surface and said clamp surface; and a drive mechanism to selectively move said clamp surface towards or away from said support surface to apply a predetermined clamp force to the bunch of media items; wherein a predetermined angle of said clamp surface relative to said support surface is substantially constant when said clamp surface is moved towards or away from said support surface.

Aptly, the apparatus further comprises:

a moveable clamp member comprising said clamp surface; and at least one elongate drive member pivotally coupled to said clamp member at a first end region of said drive member and selectively rotatable about a drive axis located at a further end region of said drive member.

Aptly, the apparatus further comprises at least one link member pivotally connected to an intermediate portion of said drive member by a first pin member and pivotally connected to a first end portion of said clamp member by a further pin member, wherein said first pin member is mounted in a first elongate slot disposed in the intermediate portion of said drive member to guide the first pin member in a direction along the drive member responsive to the drive member being selectively rotated.

Aptly, the apparatus further comprises a guide member comprising a further elongate slot, wherein said first pin member is mounted in said further elongate slot to be guided along a predetermined guide path defined by said further elongate slot responsive to said drive member being selectively rotated.

Aptly, the said first elongate slot is substantially linear and said further elongate slot is substantially curved.

Aptly, said link member is substantially L-shaped having a first end region and a further end region, said first pin member being located at the first end region and said further pin member being located at the further end region.

Aptly, the drive mechanism further comprises:

at least one fixed sector gear; and a moveable shaft coupled to said at least one drive member and comprising at least one first gear engaged with said sector gear; wherein said clamp surface is moved towards or away from said support surface responsive to selective rotation and translation of the moveable shaft.

Aptly, the drive mechanism further comprises at least one piston member mounted to the moveable shaft and moveable along a guide portion of said drive member responsive to selective rotation of the moveable shaft, wherein said piston member is biased towards a central position within said guide portion by a pair of opposed biasing members.

Aptly, the drive mechanism further comprises a fixed shaft selectively rotatable about said drive axis and supporting said drive member; wherein the fixed shaft is free to rotate relative to said drive member and rotatably couples said moveable shaft to a drive motor.

Aptly, the apparatus further comprises at least one moveable element moveable towards or away from said clamp surface responsive to a thickness associated with the bunch of media items, wherein said drive mechanism selectively moves said clamp surface towards or away from said support surface responsive to said thickness.

Aptly, the apparatus further comprises at least one sensor to sense a displacement of the moveable element towards or away from the clamp surface.

Aptly, the apparatus further comprises at least one transport belt for locating the bunch of media items, wherein an outer drive surface of said transport belt comprises said support surface.

According to a third aspect of the present invention there is provided a media item processing module comprising apparatus in accordance with the second aspect of the present invention.

According to a fourth aspect of the present invention there is provided a Self-Service Terminal (SST) comprising the media item processing module in accordance with the third aspect of the present invention.

According to a fifth aspect of the present invention there is provided a method of locating at least one media item, comprising:

clamping a bunch of media items between a clamp surface and a support surface, wherein an orientation of said clamp surface relative to said support surface is automatically controlled to be substantially constant during selective movement of said clamp surface towards or away from said support surface.

Certain embodiments of the present invention provide a method and apparatus for applying a predetermined clamp force to a bunch of media items being transported along a transport path within an SST responsive to a predetermined mode of operation of the SST.

Certain embodiments of the present invention provide a self-adjusting clamping mechanism for automatically applying a predetermined clamp force to a bunch of media items responsive to a predetermined mode of operation of a media item processing module.

Certain embodiments of the present invention provide a self-adjusting clamping mechanism for applying a predetermined clamp force to a bunch of media items responsive to a variable thickness of a bunch of media items to which the clamp force is applied.

Certain embodiments of the present invention provide a method of clamping a bunch of media items between a clamp surface and a support surface, wherein an orientation of the clamp surface relative to the support surface is automatically controlled to be substantially constant during selected movements of the clamp surface towards or away from the support surface. In turn, an accurate and repeatable document pressure control apparatus is provided without adversely affecting bunch feeding, picking and/or separation operations.

BRIEF DESCRIPTION OF DRAWINGS

Embodiments of the present invention will now be described hereinafter, by way of example only, with reference to the accompanying drawings in which.

DESCRIPTION OF EMBODIMENTS

Figure 1:
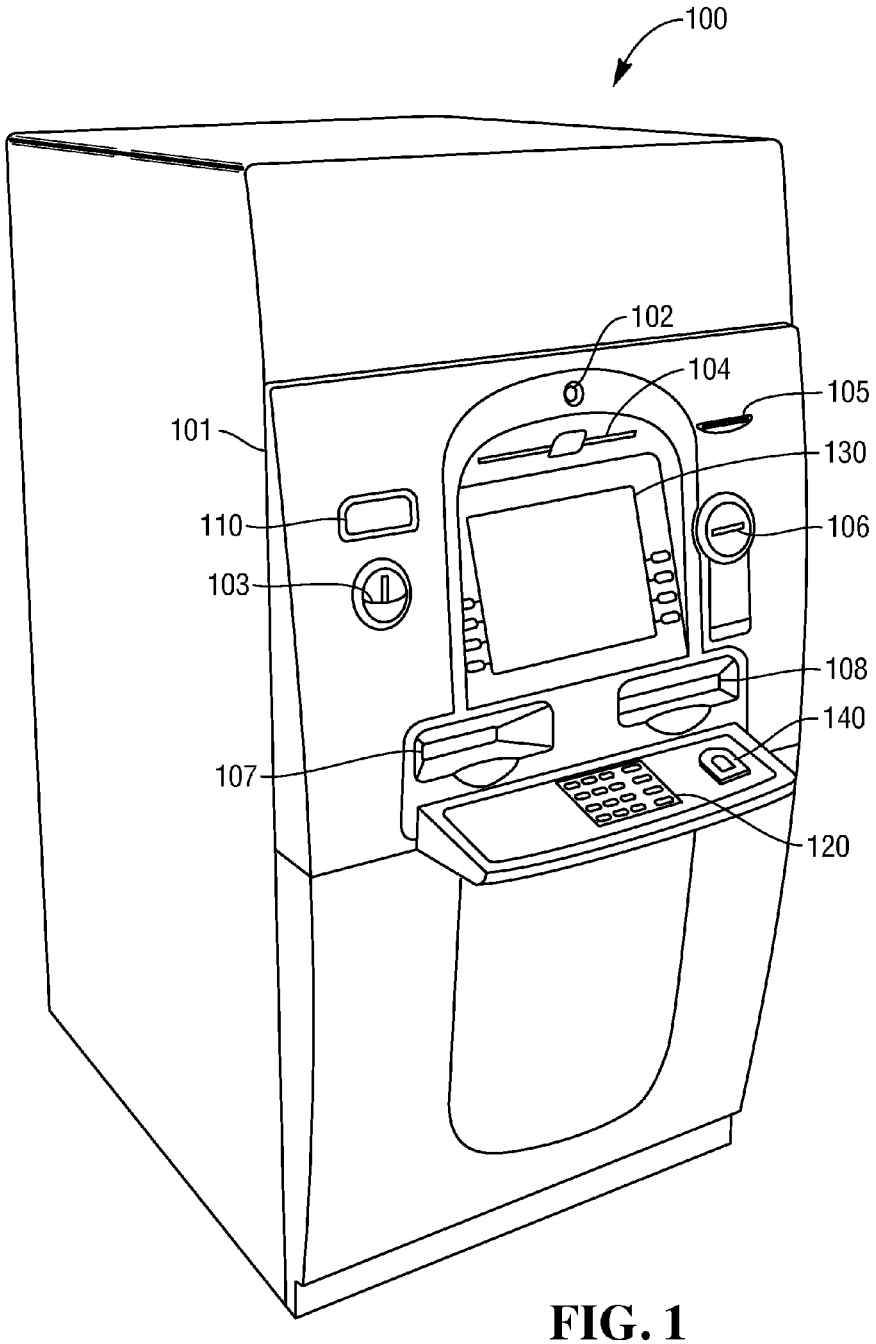
FIG. 1 illustrates an ATM according to an embodiment of the present invention.

In the drawings like reference numerals refer to like parts.

FIG. 1 illustrates a self-service check depositing terminal in the form of an image-based check depositing Automated Teller Machine (ATM) 100. It will be appreciated that certain embodiments of the present invention are applicable to a wide variety of terminals in which items of media such as checks and/or currency notes and/or giros and/or lottery tickets and/or other such flexible sheet-like items of media are to be transported and directed in different directions. The type of terminal will of course be appropriate for the type of items of media being transported.

As illustrated in FIG. 1, the ATM 100 includes a fascia 101 coupled to a chassis (not shown). The fascia 101 defines an aperture 102 through which a camera (not shown) images a customer of the ATM 100. The fascia 101 also defines a number of slots for receiving and dispensing media items and a tray 103 into which coins can be dispensed. The slots include a statement output slot 104, a receipt slot 105, a card reader slot 106, a cash slot 107, a further cash slot 108 and a check input/output slot 110. The slots and tray are arranged such that the slots and tray align with corresponding ATM modules mounted within the chassis of the ATM.

The fascia 101 provides a customer interface for allowing an ATM customer to execute a transaction. The fascia 101 includes an encrypting keyboard 120 for allowing an ATM customer to enter transaction details. A display 130 is provided for presenting screens to an ATM customer. A fingerprint reader 140 is provided for reading a fingerprint of an ATM customer to identify the ATM customer.

Within the chassis of the ATM it will be understood that items of media must be transported from time to time from one location to another. The pathway taken by any particular item of media is dependent upon an operation being carried out at the ATM and may also be dependent upon other factors such as whether a customer of the ATM is authorized and/or whether an item of media being transported satisfies certain pre-determined criteria.

Figure 2:
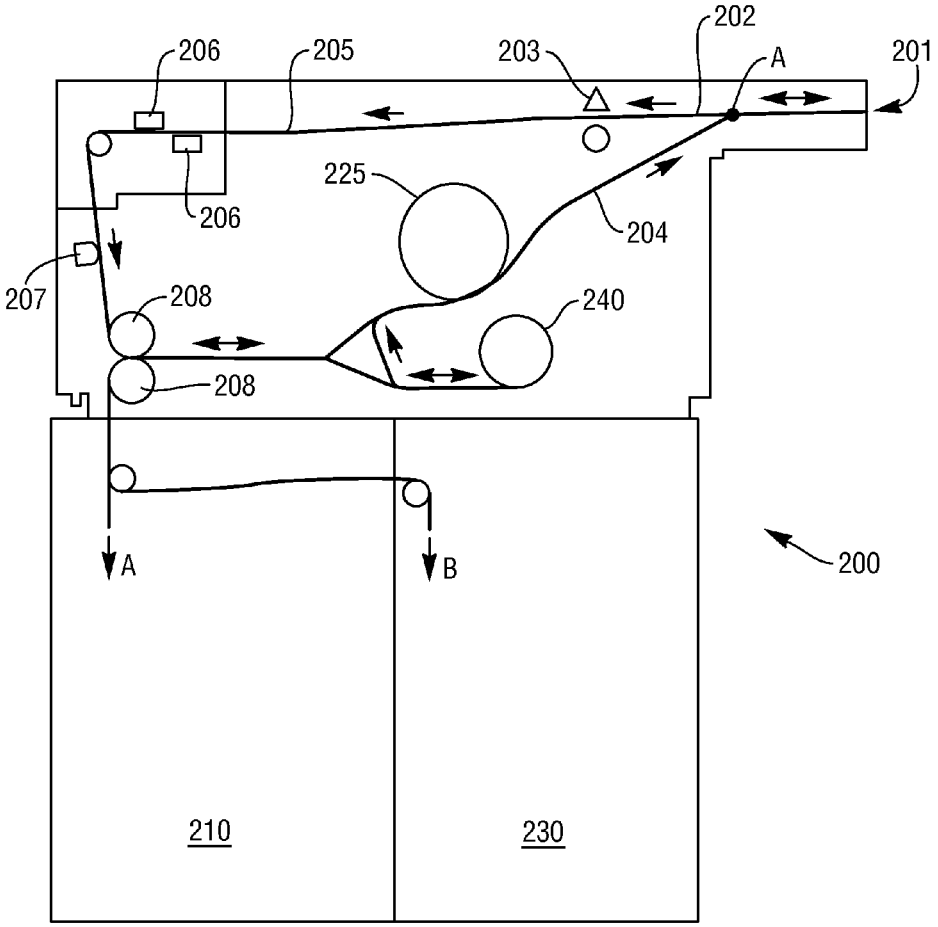
FIG. 2 illustrates transport pathways within a document processing module of the ATM of FIG. 1.

FIG. 2 illustrates possible transport pathways and internal modules within the ATM which can be utilized to process deposited checks. A check processing module 200 has an access mouth 201 through which incoming checks and/or currency notes are deposited or outgoing checks are dispensed. This mouth 201 is aligned with an infeed aperture in the ATM which thus provides an input/output slot 110. A bunch of one or more media items, such as currency notes or checks, is input or output. Aptly, a bunch of up to a hundred items or more can be received/dispensed. Incoming checks follow a first transport path 202 away from the mouth 201 in a substantially horizontal direction from right to left shown in FIG. 2. The first transport path 202 is also referred to as the Infeed' path. The checks then pass through a feeder/separator 203 and along another pathway portion 205 which is also substantially horizontal and right to left. The checks are then de-skewed and read by imaging cameras 206 and an MICR reader 207. Checks are then directed substantially vertically downwards to a point between two nip rollers 208. These nip rollers co-operate and are rotated in opposite directions with respect to each other to either draw deposited checks inwards (and urge those checks towards the right hand side in FIG. 2), or during another mode of operation, the rollers can be rotated in an opposite fashion to direct processed checks downwards in the direction shown by arrow A in FIG. 2 into a check bin 210. Incoming checks which are moved by the nip rollers 208 towards the right can either be diverted upwards (in FIG. 2) into a re-buncher unit 225, or downwards in the direction of arrow B in FIG. 2 into a cash bin 230, or to the right hand side shown in FIG. 2 into an escrow 240. Checks from the escrow can be directed to the re-buncher 225 or downwards into the cash bin 230. Checks can be reprocessed or returned to a customer via a further transport path 204, also known as the 'return' path.

Figure 3:
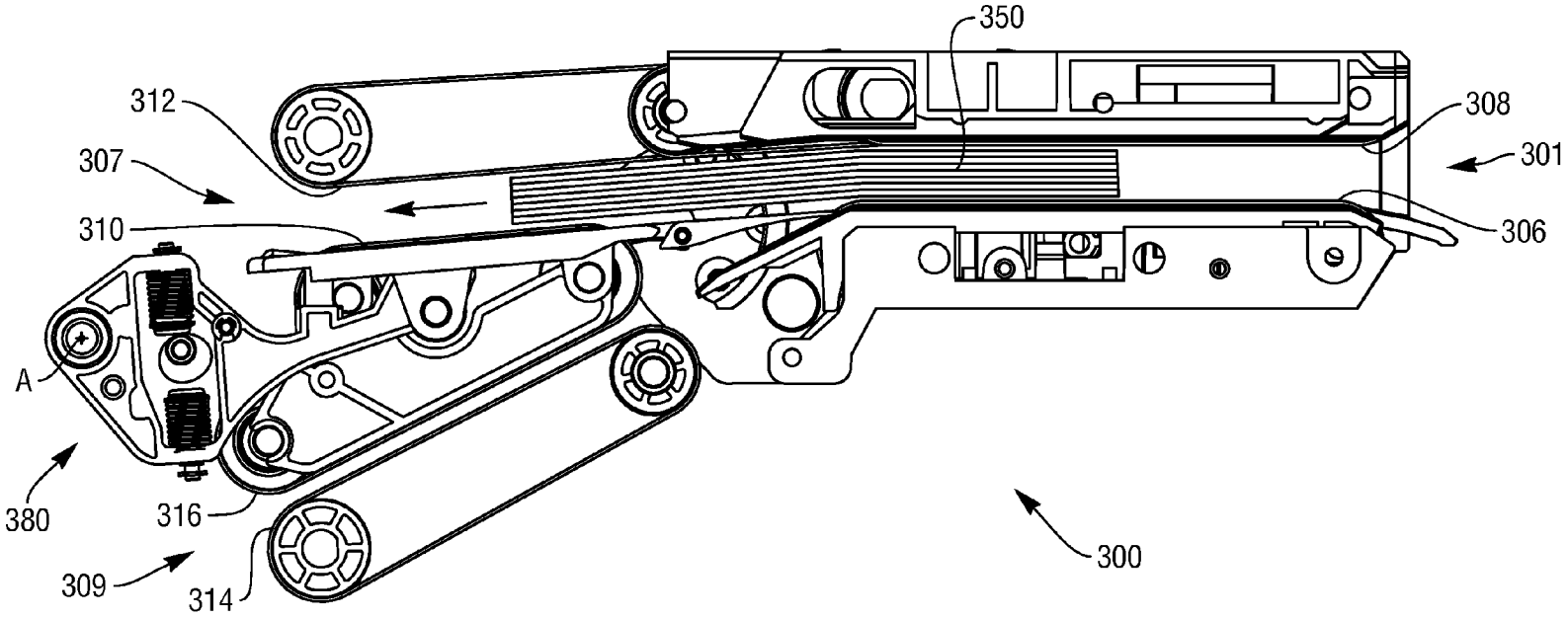
FIG. 3 illustrates a media item transport mechanism according to an embodiment of the present invention wherein the transport mechanism is in an infeed configuration for transporting a bunch of media items along an infeed transport path of the document processing module of FIG. 2.

As illustrated in FIG. 3, a media item transport mechanism 300 includes a first pair of opposed transport belts 306, 308 shown on the right-hand side of FIG. 3 for urging a bunch of media items 350 along a predetermined transport path 202, 204. An infeed end region 301 of the transport mechanism 300 is located and aligned with the access mouth 201 of the check processing module 200 for receiving a bunch of media items 350 from a customer or returning a bunch of media items to a customer. An exit end region 307 of the transport mechanism 300 includes an upper infeed transport belt 312 and a lower infeed transport belt 310 for urging a bunch 350 along the infeed transport path 202 for processing within the processing module 200. The exit end region 307 is aligned with the feeder/separator 203 of the processing module 200 for single media items to be urged along the infeed path 202 towards the feeder/separator 203 and separated from the bunch 350 to be individually processed by the processing module 200.

A return end region 309 of the transport mechanism 300 includes an upper return transport belt 316 and a lower return transport belt 314 for urging a bunch 350 along the return transport path 204 and towards the infeed end region 301 to be reprocessed along the infeed path 202 or returned to a customer via the access mouth 201 of the processing module 200.

Figure 4:
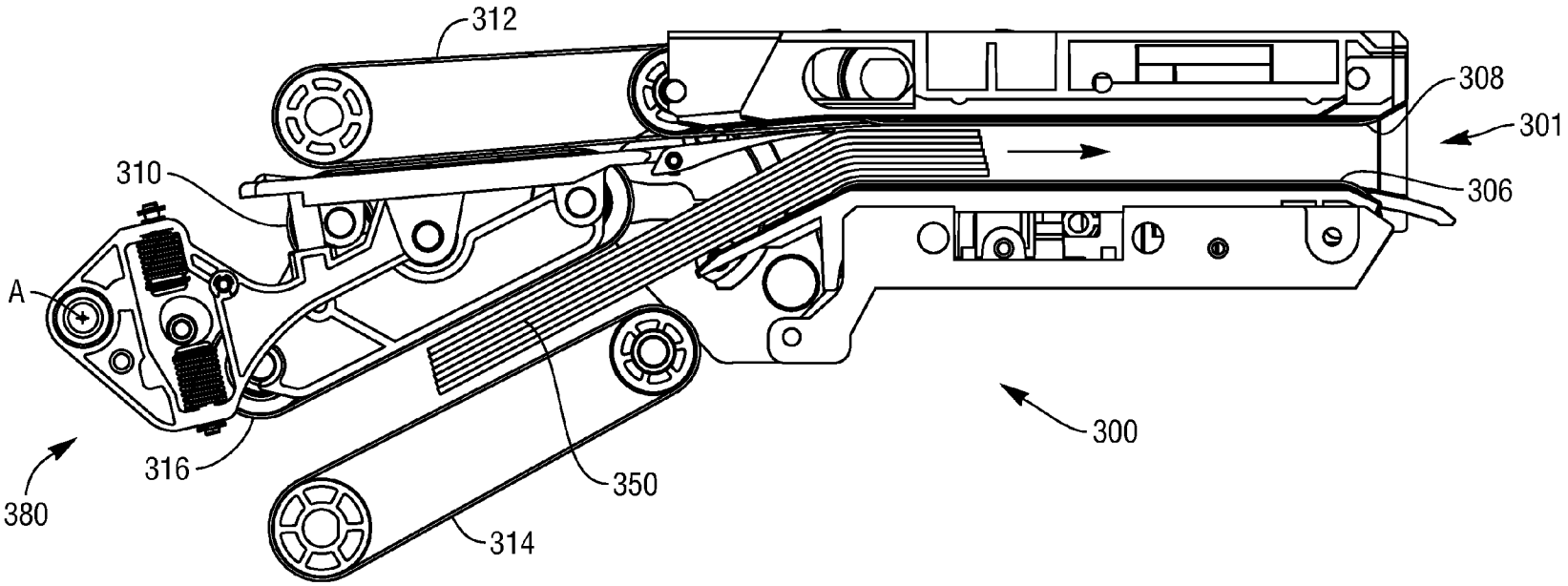
FIG. 4 illustrates the media item transport mechanism of FIG. 3 in a return configuration for transporting a bunch of media items along a return transport path of the document processing module of FIG. 2.

Aptly, one or more of the transport belts 306, 308, 310, 312, 314, 316 may comprise at least a pair of spaced apart transport belts (as shown in FIG. 4). Alternatively or additionally, rollers, gears, wheels, plates, or the like, may be used to urge one or more media items along the transport path 202, 204.

A movable clamping mechanism 380 is located between the upper infeed transport belt 312 and the lower infeed transport belt 314. The lower infeed transport belt 310 and the upper return transport belt 316 are mounted on the clamping mechanism 380. The clamping mechanism 380 is selectively movable about axis A between infeed and return positions to guide and support a bunch of media items 350 along the infeed or return path 202, 204 respectively. The clamping mechanism 380 as shown in FIG. 3 is in an infeed configuration and the clamping mechanism 380 as shown in FIG. 4 is in a return configuration.

Figure 5:
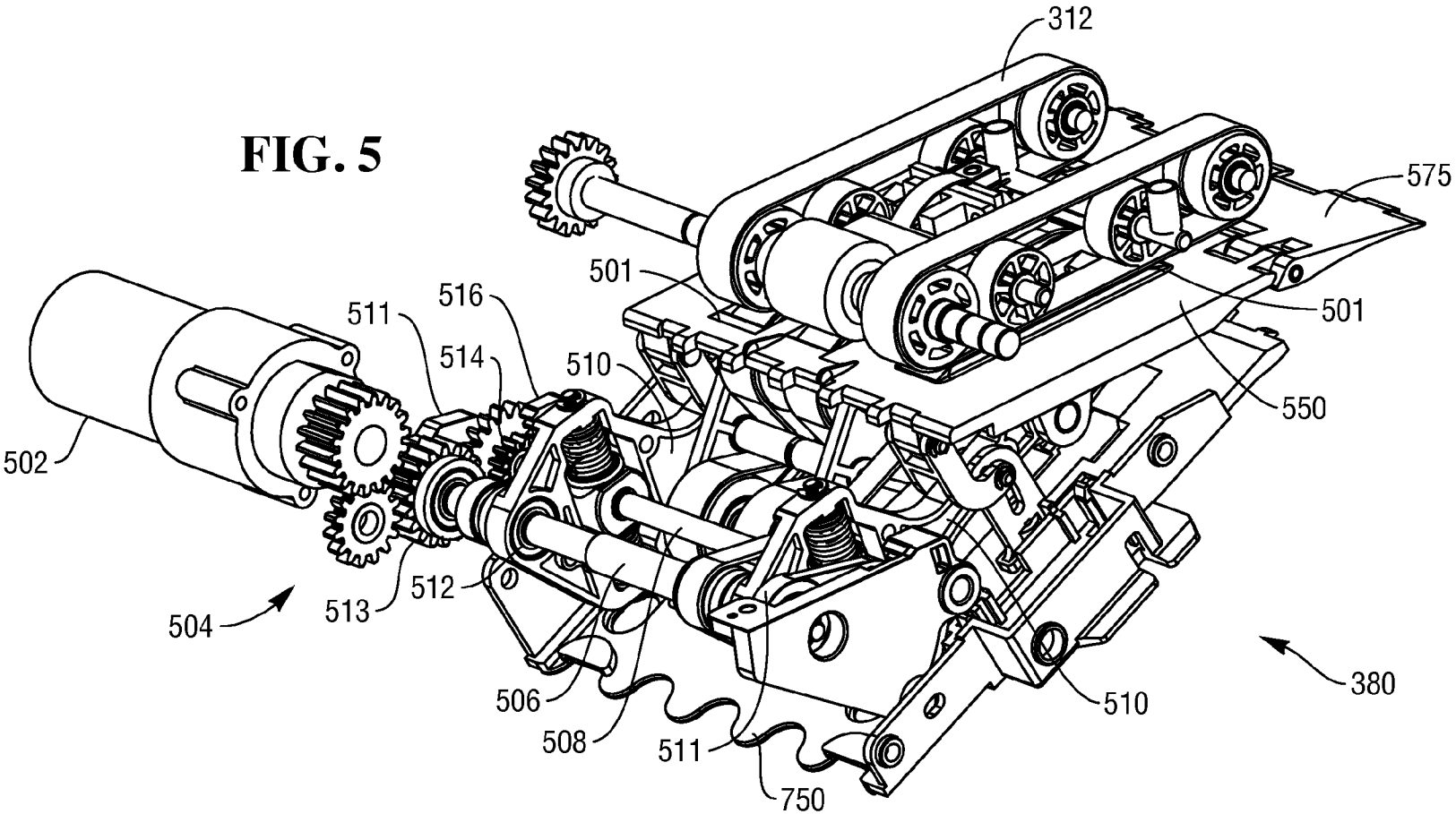
FIG. 5 illustrates a clamping mechanism of the media item transport mechanism of FIGS. 3 and 4 when in the infeed position.

As shown in FIG. 5, the clamping mechanism 380 includes a clamping member 550 for guiding and supporting a bunch of media items 350 and for applying a predetermined clamp force to the bunch of media items 350. A guide member 575 is pivotally coupled to a first end region of the clamping member 550 for guiding a bunch of media items 350 along the infeed path 202 and towards belts 310, 312 when the clamping mechanism 380 is in the infeed configuration, as shown in FIG. 3. The guide member 575 guides the bunch of media items 350 along the return path 204 when the clamping mechanism 380 is in the return configuration, as shown in FIG. 4.

The clamp member 550 includes at least a pair of spaced apart slotted apertures 501 to allow a portion of the lower infeed belt 310 to extend through and engage a bunch of media items 350 to be transported. The upper infeed transport belt 312 provides a support surface for engaging the bunch of media items 350 whilst a clamp force is applied to the bunch by the moveable clamp member 550. The clamp member 550 and the lower infeed transport belt 310 of the clamping mechanism 380 are selectively moved towards or away from the upper infeed transport belt 312 to respectively increase or decrease the clamp force applied to the bunch 350. A clamp force applied to a bunch is aptly responsive to a predetermined mode of operation of the ATM and/or a thickness of the bunch 350, as will be described below.

Figure 6:
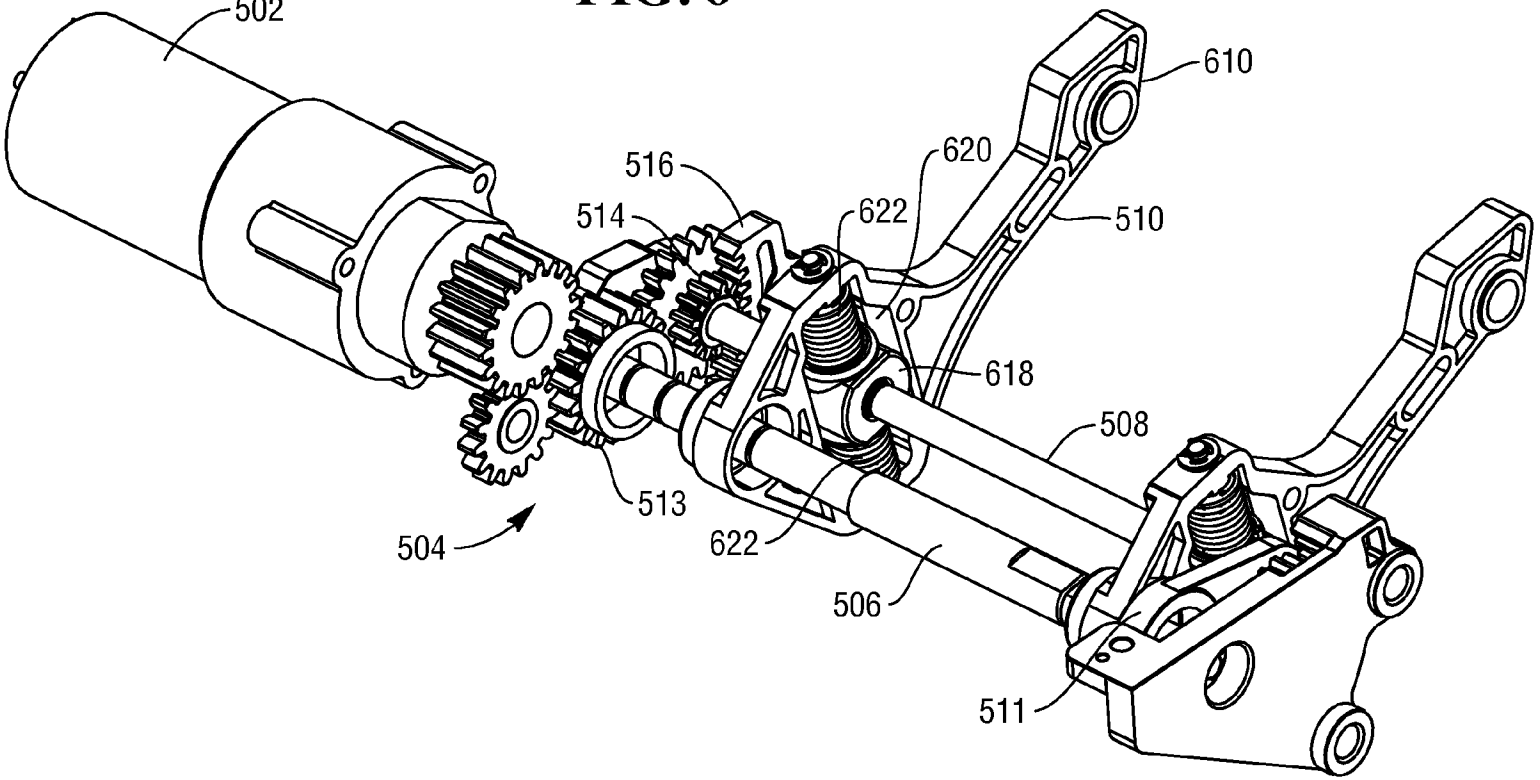
FIG. 6 illustrates detail of the drive assembly of the clamping mechanism of FIG. 5.

As illustrated in FIGS. 5 and 6, the clamping mechanism 380 includes a pair of spaced apart and parallel drive shafts 506, 508. The drive shafts 506, 508 are coupled together by a coupling member 511 located at corresponding end regions of each shaft 506, 508 to fix the spacing between the shafts 506,508 and ensure they remain parallel to each other. Each coupling arm 511 is mounted to each drive shaft 506, 508 via bearings to allow each coupling member 511 to rotate about the first drive shaft 506 and to allow the second drive shaft 508 to rotate relative to each coupling member 511. A spur gear 513 is mounted on an end of the first drive shaft 506 via a bearing such that the spur gear 513 is free to rotate on the first drive shaft 506. The second drive shaft 508 includes a spur gear 514 mounted on each of its ends. Each of the spur gears 514 engages a respective fixed sector gear 516 such that when the second drive shaft 508 is rotated, the spur gears 514, and in turn the second drive shaft 508, ascend or descend the fixed sector gears 516. A drive motor 502 drives the spur gears 514 via the gear 513 to selectively move the second drive shaft 508.

A pair of spaced apart elongate drive arms 510 are rotatably mounted via a respective bearing 512 on the first drive shaft 506 such that the drive arms 510 are free to rotate about the first drive shaft 506. The second drive shaft 508 further includes a pair of spaced apart piston members 618 mounted on respective end portions by respective bearings (not shown) such that the second drive shaft 508 is free to rotate with respect to each piston member 618. Each piston member 618 sits in and is guided by a respective slotted opening 620 in each of the drive arms 510. Each piston member 618 is biased towards a central position within its respective slotted opening 620 by a respective pair of opposed compression springs 622.

In operation, the drive motor 502 rotates the second drive shaft 508 via gear arrangement 504 such that, in view of the spur gear 514 and fixed sector gear 516 arrangement, the second drive shaft 508 moves up or down with respect to the first drive shaft 506 responsive to the direction of the motor 502. In turn, the piston members 618 move up or down in their corresponding slotted openings 620. The force applied to the corresponding spring 622 by a respective piston member 618 is transmitted to the drive arms 510 to move the same in an upward/anti-clockwise or downward/clockwise direction about the drive axis A (as viewed in FIG. 7).

Figure 7:
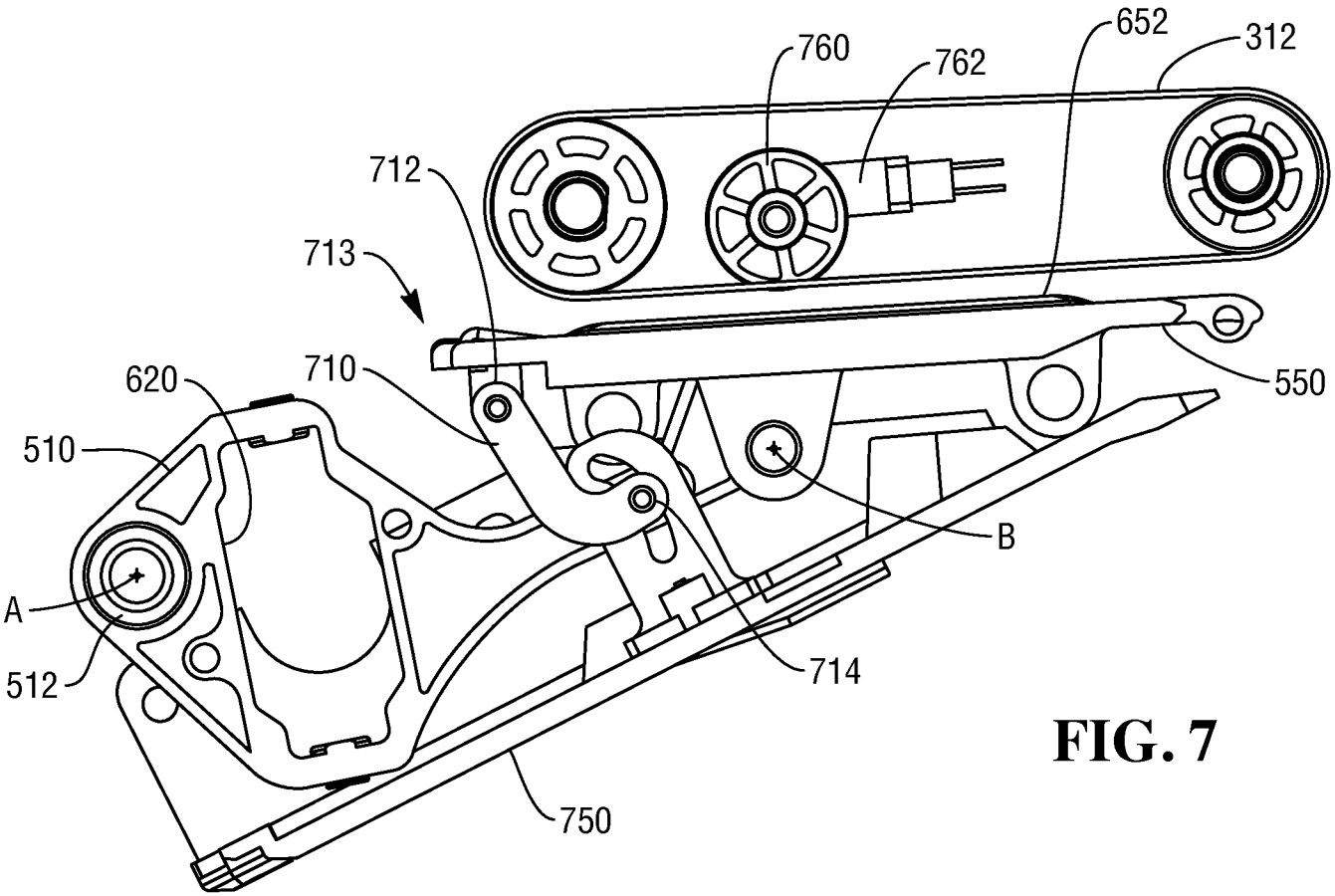
FIG. 7 illustrates a side view of a drive arm and clamp member of the clamping mechanism of FIG. 5.

As illustrated in FIGS. 6 and 7, an end 610 of each drive arm 510, distal to the drive axis A, is pivotally coupled to the clamp member 550 at axis B. The clamp member 550 includes a number of upwardly extending ribs 652 to support and guide a bunch of media items 350 along the predetermined transport path 202, 204. The clamp member 550 is also coupled to each drive arm 510 by a respective link arm 710. Each link arm 710 is substantially L-shaped and pivotally connected at a first end 712 to an edge region 713 of the clamp member 550 and at a second end 714 to an intermediate portion of each drive arm 510. 'L-shaped' has been chosen to describe the two portions of each link arm 710 which are oriented generally perpendicularly to each other but, of course, other suitable shapes and orientations may be suitable, such as a reverse 'J' shape for example.

Figure 8A:
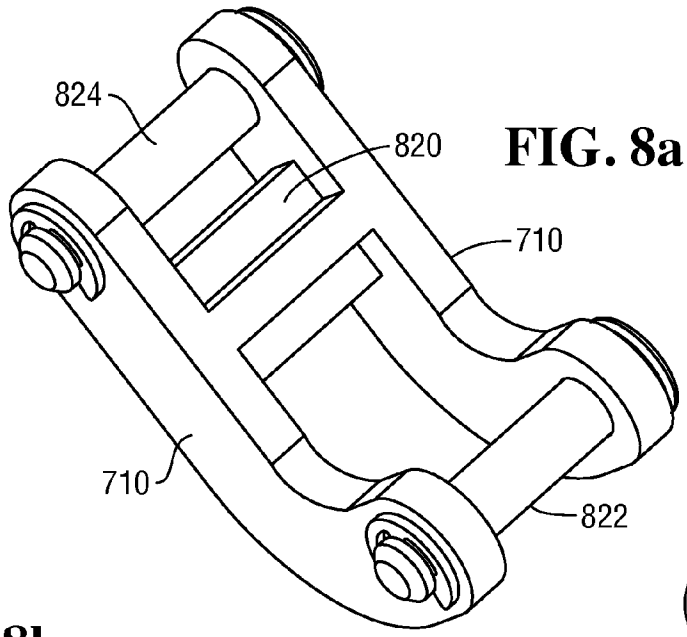
FIGS. 8*a* and 8*b* illustrate a link arm and pin assembly for coupling a respective drive arm to the clamp member.
Figure 8B:
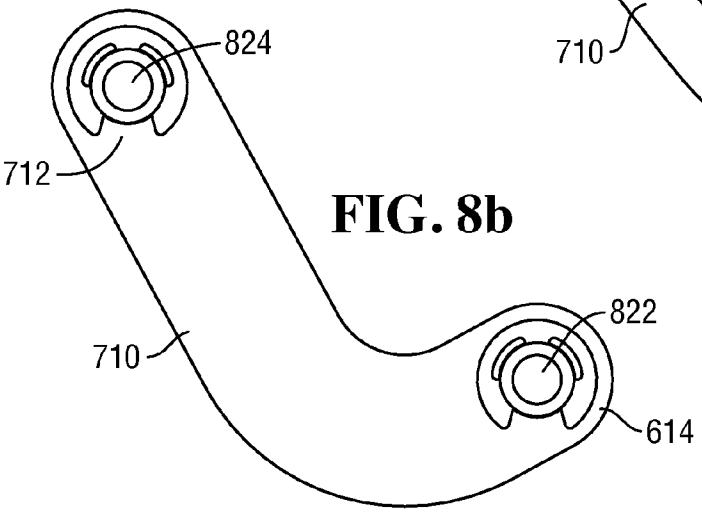
Figure 8C:
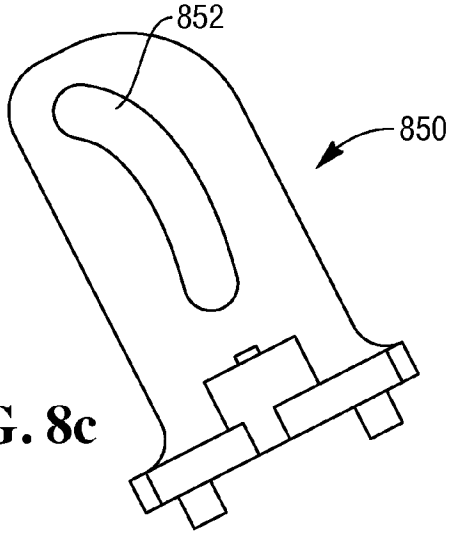
FIG. 8*c* illustrates a guide member for guiding the lower pin of a respective link arm assembly.
Figure 9:
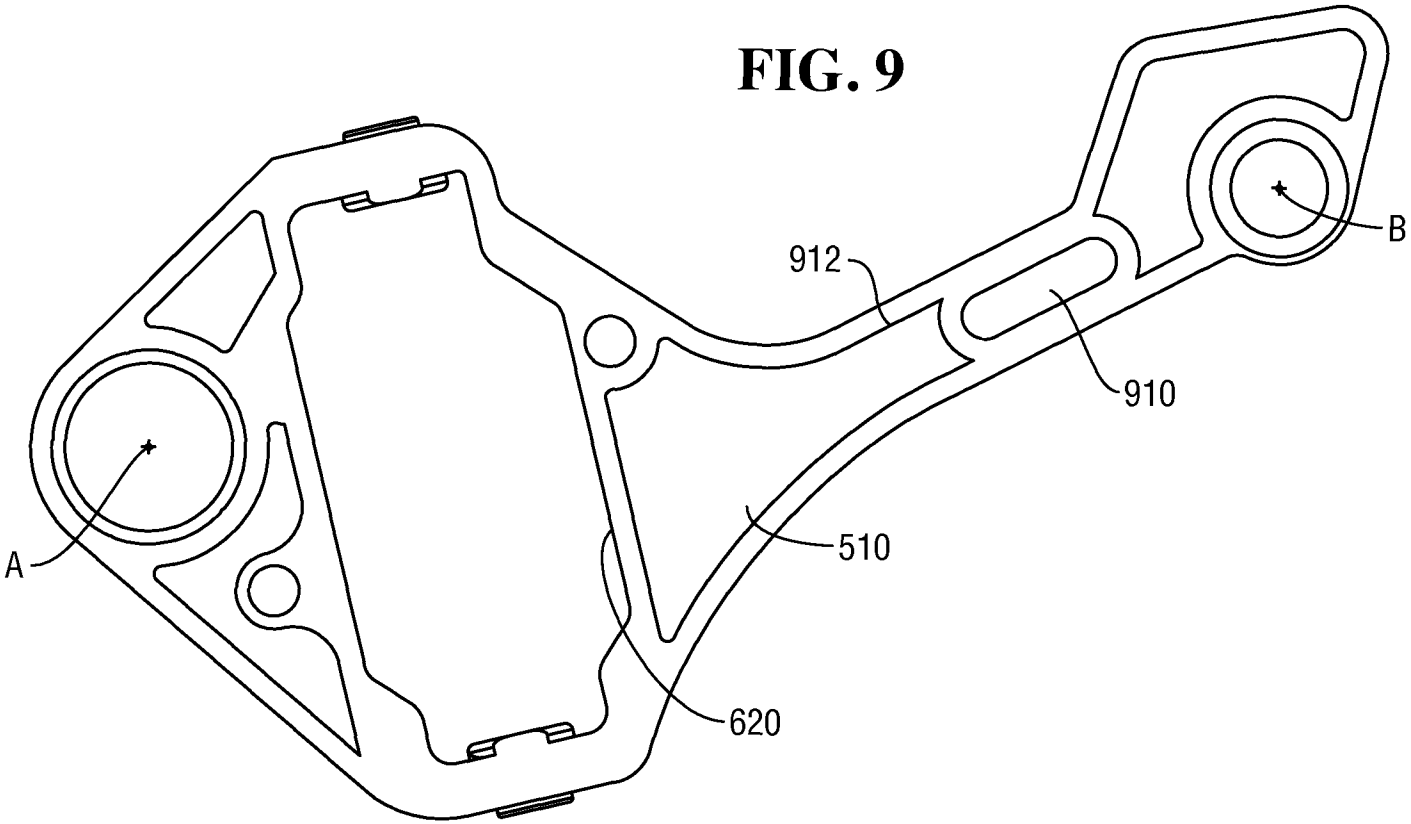
FIG. 9 illustrates a side view of a drive arm.

As illustrated in FIGS. 8*a* and 8*b*, each link arm arrangement for coupling a respective drive arm 510 to the clamp member 550 comprises a pair of link arms 710, connected at corresponding intermediate portions by a cross member 820, and a pair of pin members 822, 824. The lower pin member 822 is supported in an elongate linear slot 910 located in an intermediate portion 912 of a respective drive arm 510 between axes A and B (as shown best in FIG. 9). Each lower pin member 822 is also supported and guided by a further elongate slot 852 of a guide member 850 (as shown in FIG. 8*c*). Each respective guide member 850 is fixed to a body portion 750 of the transport mechanism 300 which comprises a return tray 750 for supporting and guiding media items being transported along the return path 204.

In operation, as a drive arm 510 is rotated in an upward/counter-clockwise direction about the drive axis A of the first shaft 506, the respective lower pin member 822, and in turn the respective J-shaped link member 710, is moved generally from right to left in the first slotted opening 910 of the drive arm 510 and generally upwardly in the second slotted opening 852 of the guide member 850. This movement in turn lifts a second end region 713 of the clamp member 550 (which is a trailing end region in the infeed configuration) to rotate the clamp member 550 about axis B. Such an arrangement automatically ensures the angle of an upper surface 652 of the clamp member 550 is kept substantially constant during movement of the clamp member 550 towards or away from the outer drive surfaces of the pair of spaced apart upper infeed transport belts 312. As shown in FIGS. 3 and 4, the lower infeed belt 310 of the clamping mechanism 380 is kept substantially parallel with the upper infeed belts 312 of the transport mechanism 300 during selective movement of the clamping mechanism 380 between infeed and return configurations. In turn, the upper return belt 316 of the clamping mechanism 380 is kept substantially parallel with the lower return belt 314 of the transport mechanism 300 during selective movement of the clamping mechanism 380 between infeed and return configurations. This provides for effective feeding and return operations and accurate and repeatable media item pressure control.

Figure 10:
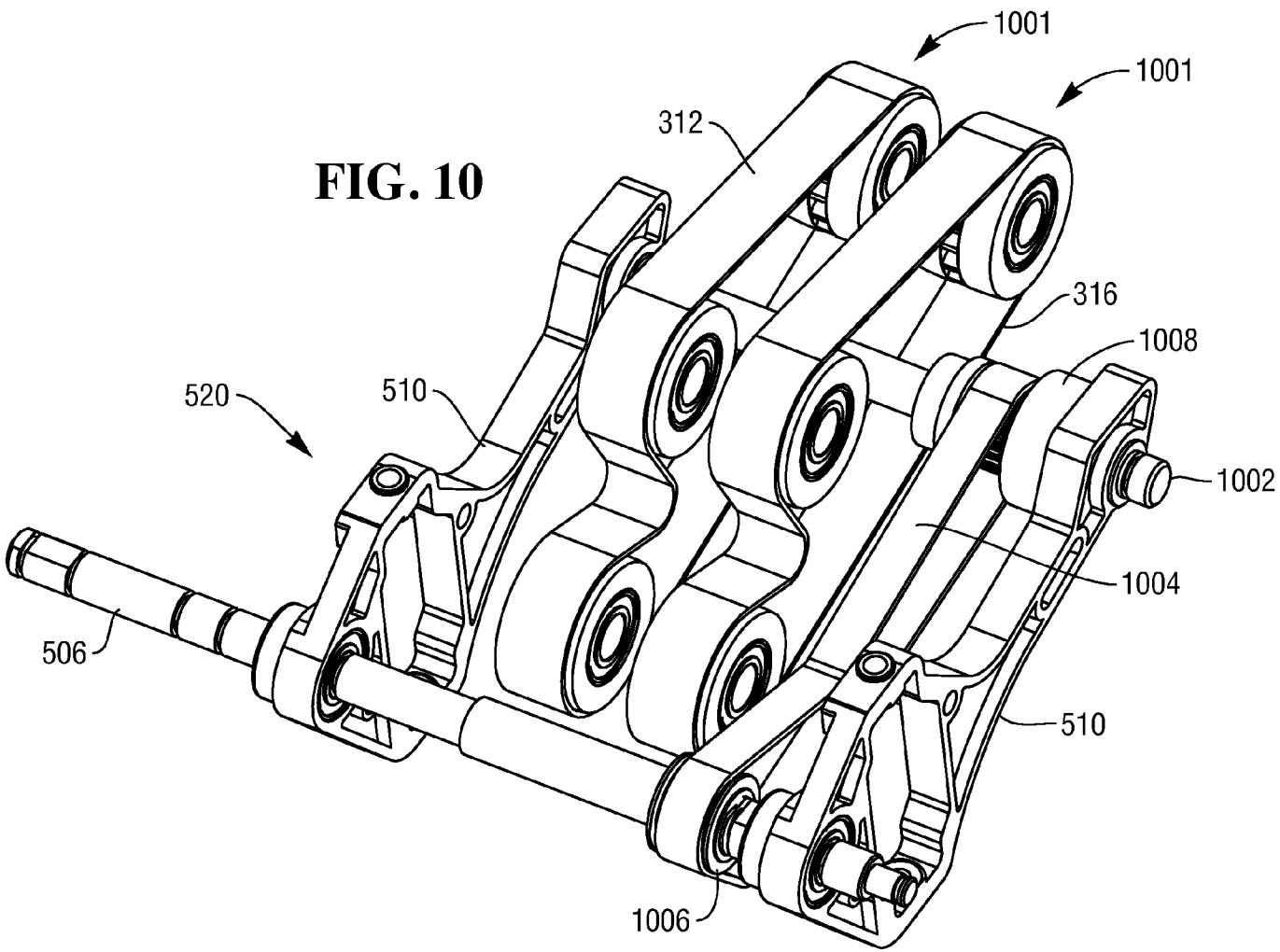
FIG. 10 illustrates detail of the transport belts of the clamping mechanism.
Figure 11A:
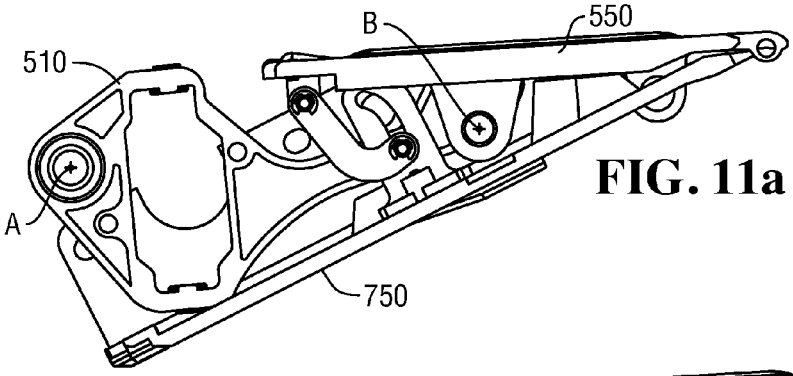
FIGS. 11*a* to 11*d* illustrate different configurations of the clamping mechanism wherein an angle of the clamp member is kept substantially constant.
Figure 11B:
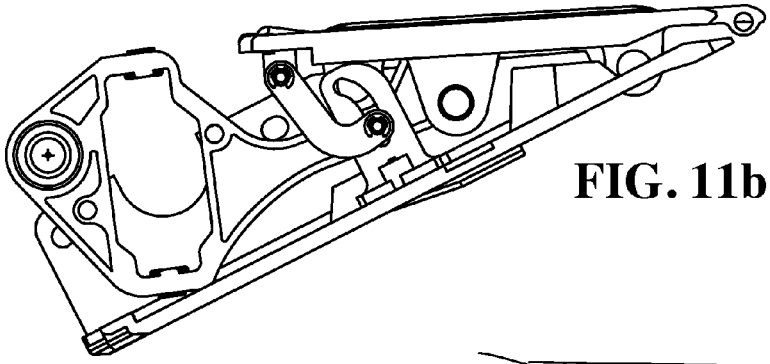
Figure 11C:
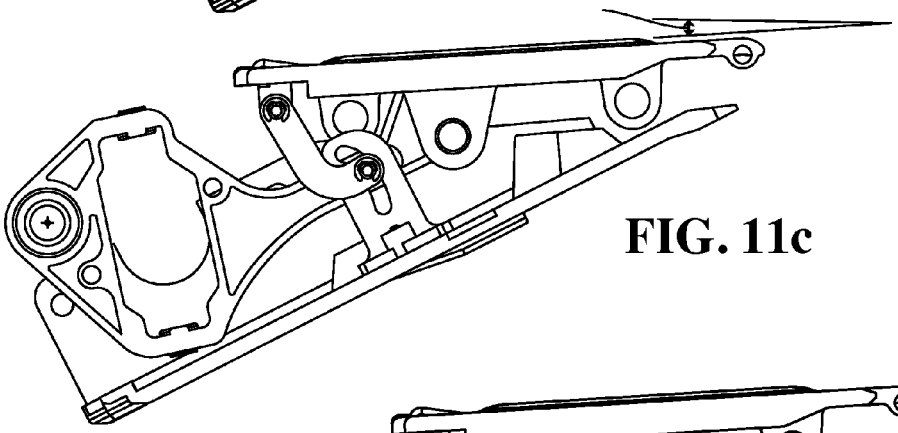
Figure 11D:
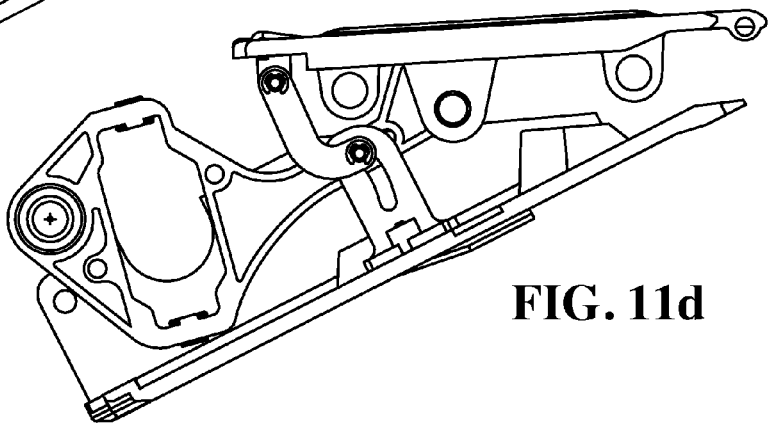

The lower infeed belt 310 and upper return belt 316 of the clamping mechanism 380 may be separate belts mounted on respective rollers or pulleys and driven independently by respective motors. Alternatively, the lower infeed belt 310 and upper return belt 316 may be provided by respective portions of a single belt 1001 as shown in FIG. 10. The first drive shaft 506 is driven by a further motor (not shown) which in turn drives a further drive shaft 1002 mounted via bearings to the distal end region 610 of each drive arm 510. A drive belt 1004 is mounted on respective pulleys 1006, 1008 of the first and further drive shafts 506, 1002 to couple the first and further drive shafts 506, 1002 together. The further drive shaft 1002 drives a pair of spaced apart transport belts 1001 which each provide the lower infeed belt 312 and upper return belt 316 of the clamping mechanism 380.

When being transported along the infeed path 202, a bunch of media items moves from right to left to be located between the clamp member 550 and the pair of spaced apart upper infeed transport belts 312. When the bunch is moved to a location proximal to an idler roller 750 (as shown in FIG. 7), the bunch counteracts a force exerted on the upper transport belts 312 by the idler roller 760 and forces the idler roller away from the clamp member 550. The distance by which the idler roller 760 is moved away from the clamp member 550 by the bunch is dependent upon the thickness of the bunch and the position of the clamp member 550 relative to the upper infeed belts 312. For example, for a given position of the clamp member 550 relative to the upper infeed belts 312, a relatively thick bunch of media items will displace the idler roller by a greater amount than a relatively thin bunch of media items. As media items are removed from a bunch by a feeder/separator module, the thickness of the bunch will decrease and the clamp member 550 is required to move towards the upper infeed belts 312 to accommodate for this change in thickness in order to apply a pre-determined clamping force to the bunch. In a similar manner, when media items are added to a bunch by the feeder/separator module, the thickness of the bunch will increase and the clamp member 550 will be required to move away from the upper infeed belts 312 to accommodate for this change in thickness in order to apply the pre-determined clamping force to the bunch. A sensor 762 determines the displacement of the idler roller 760 to control the drive motor 502 accordingly and in turn a selective position of the clamp member 550 relative to the upper infeed belts 312 to apply a predetermined clamp force to a bunch of media items 350.

As shown in FIGS. 11*a* to 11*d*, the clamping mechanism 380 according to certain embodiments of the present invention therefore automatically adjusts the orientation of the clamp member 550 (and in turn the lower infeed belts 310) as the pair of drive arms 510 are selectively rotated about axis A to move the clamp member 550 towards or away from the upper infeed transport belts 312. In turn, a pre-determined angle $\alpha$ of the clamp member 550 (and lower infeed belts 310) relative to the upper infeed transport belts 312 is kept substantially constant during said movement of the clamp member 550. This allows for accurate, reliable and consistent media item pressure control. In a similar manner, a pre-determined angle of the upper return belts 316 of the clamping mechanism 380 relative to the lower return belts 314 of the transport mechanism 300 is kept substantially constant during said movement of the clamp member 550, Thus, the clamping mechanism according to certain embodiments of the present invention automatically moves a clamp member toward or away from an upper transport belt responsive to a change in thickness of a bunch of media items located between the clamp member and the upper infeed transport belts to thereby ensure a pre-determined clamp force applied to the bunch by the clamp member is substantially constant for effectively removing or adding media items from or to the bunch. The clamping mechanism according to certain embodiments of the present invention allows a pre-determined clamp force to be applied to a bunch of media items for effectively transporting the bunch along a pre-determined transport path. The clamping mechanism according to certain embodiments of the present invention provides a form of force feedback detect on a bunch of media items to ultimately control a clamp force applied to the bunch by the clamping mechanism.

Throughout the description and claims of this specification, the words "comprise" and "contain" and variations of them mean "including but not limited to" and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of the features and/or steps are mutually exclusive. The invention is not restricted to any details of any foregoing embodiments. The invention extends to any novel one, or novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

What is claimed is:

1. A method of transporting at least one media item along a transport path, comprising:

locating a bunch of media items between at east one support surface and at least one clamp surface; and selectively moving said clamp surface towards or away from said support surface to apply a predetermined clamp force to the bunch of media items;

maintaining an infeed region of a clamping mechanism for an infeed configuration of the bunch of media items in a constant position when said clamp surface moves toward and away from the support surface and maintaining a return region of the clamping mechanism for a return configuration of the bunch of media items in a constant position when said clamp surface moves toward and away from the support surface;

selectively notating at least one elongate drive member coupled at a first end region of said drive member to a clamp member comprising said clamp surface;

automatically adjusting the angle of said clamp surface responsive to rotation of the at least one drive member such that the predetermined angle of said clamp surface relative to said support surface is substantially constant when said clamp surface is moved towards or away from said support surface; and guiding at least one link member along a predetermined guide path during said rotation of the at least one drive member to automatically adjust an orientation of the clamp member, wherein a first end region of said link member is pivotally connected to said drive member and a further end region of said link member is pivotally connected to said clamp member through an elongated slot member.

2. The method as claimed in claim 1, wherein the predetermined angle is from around 0 degrees to around 10 degrees.

3. The method as claimed in claim 1, further comprising:

determining a thickness associated with the bunch of media items; and selectively moving said clamp surface towards or away from said support surface responsive to the thickness.

4. Apparatus for transporting at least one media item along a transport path, comprising:

at least one clamp surface to apply a clamp force to a bunch of media items located between a support surface and said clamp surface;

a drive mechanism to selectively move said clamp surface towards or away from said support surface to apply a predetermined clamp force to the bunch of media items an infeed region for an infeed configuration of the bunch of media items that is maintained in a constant position when said clamp surface moves toward and away from said support surface;

a return region for a return configuration of the bunch of media items that is maintained in a constant position when said clamp surface moves away from said support surface;

a moveable clamp member comprising said clamp surface:

at least one elongate drive member pivotally coupled to said clamp member at a first end region of said drive member and selectively rotatable about a drive axis located at a further end region of said drive member:

at least one link member pivotally connected to an intermediate portion of said drive member by a first pin member and pivotally connected to a first end portion of said clamp member by a further pin member, wherein said first pin member is mounted in a first elongate slot disposed in the intermediate portion of said drive member to guide the first pin member in a direction along the drive member responsive to the drive member being selectively rotated; and a guide member comprising a further elongate slot, wherein said first pin member is mounted in said further elongate slot to be guided along a predetermined guide path defined by said further elongate slot responsive to said drive tuber being selectively rotated, wherein said first elongate slot is substantially linear and said further elongate slot is substantially curved.

5. The apparatus as claimed in claim 4, wherein the drive mechanism further comprises:

at least one fixed sector gear; and a moveable shaft coupled to said at least one drive member and comprising at least one first gear engaged with said sector gear; wherein said clamp surface is moved towards or away from said support surface responsive to selective rotation and translation of the moveable shaft.

6. The apparatus as claimed in claim 5, wherein the drive mechanism further comprises:

at least one piston member mounted to the moveable shaft and moveable along a guide portion of said drive member responsive to selective rotation of the moveable shaft, wherein said piston member is biased towards a central position within said guide portion by a pair of opposed biasing members.

7. The apparatus as claimed in claim 4, further comprising:

at least one transport belt for locating the bunch of media items, wherein an outer drive surface of said transport belt comprises said support surface.

8. A media item processing module comprising the apparatus as claimed in claim 4.

* * * * *